US008668492B2

(12) United States Patent
Carroll

(10) Patent No.: US 8,668,492 B2
(45) Date of Patent: Mar. 11, 2014

(54) REMOVABLE WICK

(76) Inventor: Jacqueline Elaine Carroll, Landover, MD (US)

( * ) Notice: Subject to any disclaimer, the term of this patent is extended or adjusted under 35 U.S.C. 154(b) by 625 days.

(21) Appl. No.: 12/661,087

(22) Filed: Mar. 10, 2010

(65) Prior Publication Data

US 2010/0291499 A1 Nov. 18, 2010

Related U.S. Application Data

(60) Provisional application No. 61/169,814, filed on Apr. 16, 2009.

(51) Int. Cl.
*F23D 3/16* (2006.01)

(52) U.S. Cl.
USPC ..... 431/288; 431/289; 431/325

(58) Field of Classification Search
USPC ..... 431/288, 289, 291, 292, 302, 303, 325, 431/329
See application file for complete search history.

(56) References Cited

U.S. PATENT DOCUMENTS

| | | | | | |
|---|---|---|---|---|---|
| 2,001,377 | A * | 5/1935 | Candy, Jr. | ..... | 431/291 |
| 2,189,412 | A * | 2/1940 | Arnone | ..... | 431/325 |
| 2,291,067 | A * | 7/1942 | Atkins | ..... | 431/291 |
| 2,481,019 | A * | 9/1949 | Joyce | ..... | 431/126 |
| 2,713,256 | A * | 7/1955 | Oesterle et al. | ..... | 431/291 |
| 2,758,460 | A * | 8/1956 | Ciano | ..... | 431/298 |
| 2,809,512 | A * | 10/1957 | Hartnett | ..... | 431/294 |
| 2,818,718 | A * | 1/1958 | Roberts | ..... | 431/291 |
| 3,121,316 | A * | 2/1964 | Wilson et al. | ..... | 431/206 |
| 3,428,409 | A * | 2/1969 | Summers | ..... | 431/289 |
| 3,652,197 | A * | 3/1972 | Tokarz | ..... | 431/326 |
| 3,741,711 | A * | 6/1973 | Bryant | ..... | 431/125 |
| 4,568,270 | A * | 2/1986 | Marcus et al. | ..... | 431/288 |
| 4,790,747 | A * | 12/1988 | O'Brien | ..... | 431/325 |
| 4,917,597 | A * | 4/1990 | Henze | ..... | 431/289 |
| 5,078,591 | A * | 1/1992 | Despres | ..... | 431/75 |
| 5,078,945 | A * | 1/1992 | Byron | ..... | 264/278 |
| 5,193,994 | A * | 3/1993 | Schirneker | ..... | 431/293 |
| 5,842,850 | A * | 12/1998 | Pappas | ..... | 431/291 |
| 6,036,477 | A * | 3/2000 | Frandsen | ..... | 431/291 |
| 6,062,847 | A * | 5/2000 | Pappas | ..... | 431/35 |
| 6,241,512 | B1 * | 6/2001 | Freeman et al. | ..... | 431/291 |
| 6,270,340 | B1 * | 8/2001 | Lepp | ..... | 431/288 |
| 6,361,311 | B1 * | 3/2002 | Smith | ..... | 431/291 |
| 6,409,501 | B1 * | 6/2002 | Pappas | ..... | 431/289 |
| 6,428,311 | B1 * | 8/2002 | Bernardo | ..... | 431/293 |
| 6,638,060 | B1 * | 10/2003 | Rivard et al. | ..... | 431/289 |
| 6,758,667 | B2 * | 7/2004 | Wilson | ..... | 431/325 |
| 7,261,848 | B2 * | 8/2007 | Yekutiely | ..... | 264/112 |

* cited by examiner

*Primary Examiner* — Steven B McAllister
*Assistant Examiner* — Desmond C Peyton

(57) ABSTRACT

A removable, candle wick for its ability to be removed from a body of meltable wax and replaced on the same body of meltable wax or placed on a different body of wax. Being anchored on a metal wick tab allows wick to be placed on top of a flat wax surface with stem portion being ignited with a flame. As wax melts the wick tab sinks into the wax and can be extinguished and removed from wax before wax hardens and then placed in a container and reused as desired. The wick will burn wax completely and evenly, and after burning a body of wax, entirely extinguished and placed on a new body of wax to start a new burning. The wick will burn as long as it comes in contact with a meltable body of wax.

2 Claims, 8 Drawing Sheets

REMOVABLE WICK

This application claims benefit of U.S. provisional application Ser. No. 61/169,814, Filed Apr. 16, 2009 by Jacqueline Carroll.

BACKGROUND

Originally candles where made with a standard built-in-candle wick, which prove to be troublesome as a built-in-candle wick mostly always become buried in candle wax, leaving individual with the problem of having to dig out built-in-candle wick in order to continue burning candle. This problem has been partially solved by adding multiple built-in-candle wicks. I found that these had and still have significant problems as multiple built-in-candle wicks still becomes buried in candle wax. In addition built-in-candle wicks often burn away before wax, leaving wasted candle wax unable to be burned.

SUMMARY

Removable wick is a multipurpose portable candle wick that is to be used to replace a standard built-in candle wick when it becomes buried in candle wax without having to dig out the built-in candle wick of candle wax and then can be removed and used again multiple times on the same or a different candle. If the built-in candle wick burns away before the candle wax, removable wick can then take the place of the built-in candle wick to burn candle completely, not leaving half of the candle to be wasted and thrown out.

The invention provides a free standing portable candle wick assembly having a metal candle wick tab having a hole in its center; a wick comprising a cotton flat braid having a first end and a second end; wherein the first end of the wick is situated in the hold of the candle wick tab and a first segment of the wick extends upward and away from the candlewick tab to a top portion of the wick, the top portion being intermediate the first and second end of the wick, and wherein a second segment of the wick intermediate the top portion of the wick and the second end of the wick extends downward and back to the candlewick tab and winds around the first segment of the wick to form a wound wick assembly, the cross-sectional dimension progressively increasing until it reaches a maximum cross-sectional dimension at the candlewick tab; and a body of meltable wax surrounding the wick and form which the top portion of the wick protrudes.

The invention also provides a candle having a container; a first body of meltable wax within the container; a free standing portable candle wick assembly resting on top of the first body of meltable wax, the free standing portable candlewick assembly comprising: a melting candlewick tab having a hole in its center; a wick comprising a cotton flat braid having a first end and a second end; wherein the first end of the wick is situated in the hole of the candlewick tab and a first segment of the wick extends upward and away from the candlewick tab to a top portion of the wick, the top portion being intermediate the first and second end of the wick, and wherein a second segment of the wick intermediate the top portion of the wick and the second end of the wick extends downward and back to the candlewick tab and winds around the first segment of the wick to form a wound wick assembly, the wound wick assembly having a smallest cross-sectional dimension at the top portion of the wick, the cross-section dimension progressively increasing until it reaches a maximum cross-sectional dimension at the top candlewick tab; and a second body of meltable wax surrounding the wick and form which the top portion of the wick protrudes.

DRAWINGS-FIGURES

Figure 1:
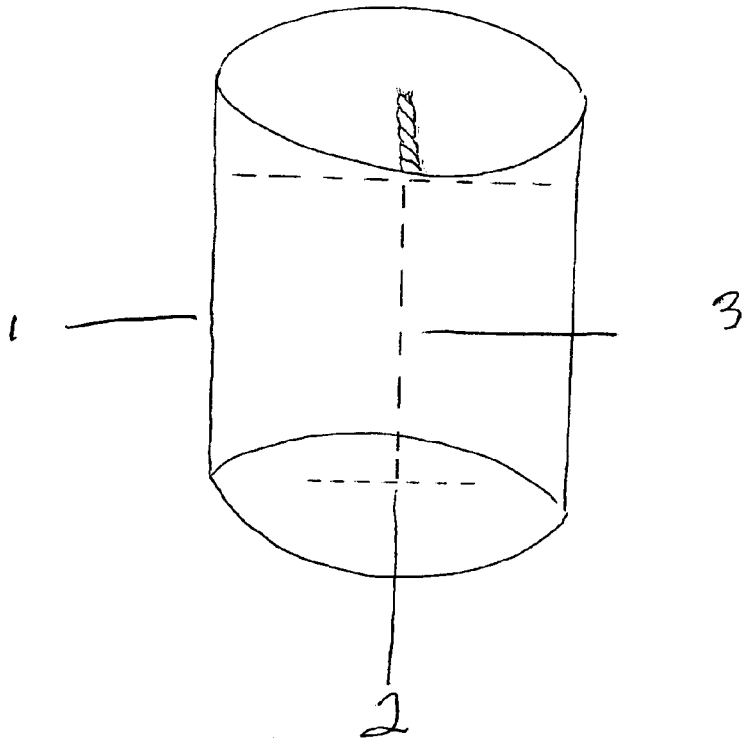
Fig 1 Prior Art
FIG. 1 shows prior art with standard built-in-candle wick.
Figure 2:
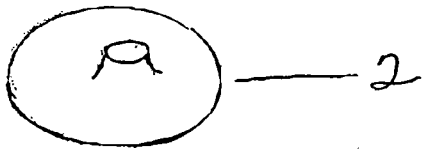
Fig 2 Prior Art
FIG. 2 shows top view of metal candle wick tab.
Figure 3:
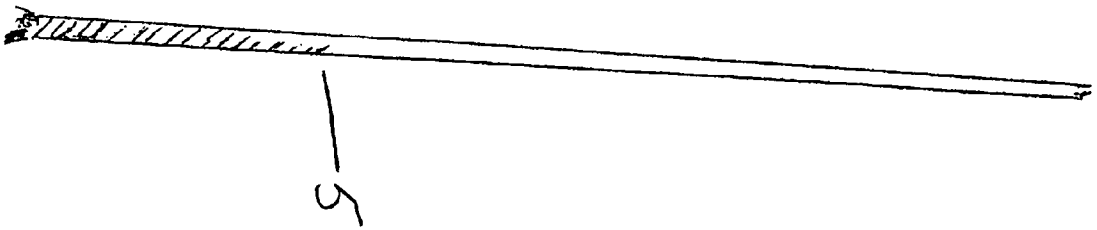
Fig 3 Prior Art
FIG. 3 shows front view of flat braided candle wick in a vertical position.
Figure 4:
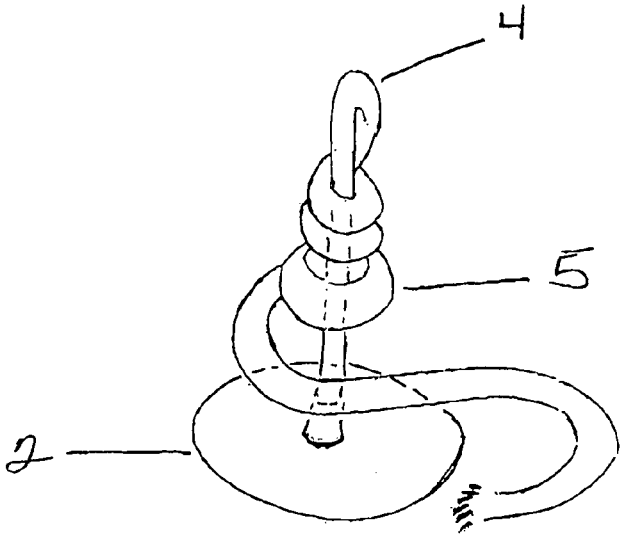
FIG. 4 shows front view of wick inserted and anchored in place on wick tab with stem formed at beginning of coiling process.
Figure 5:
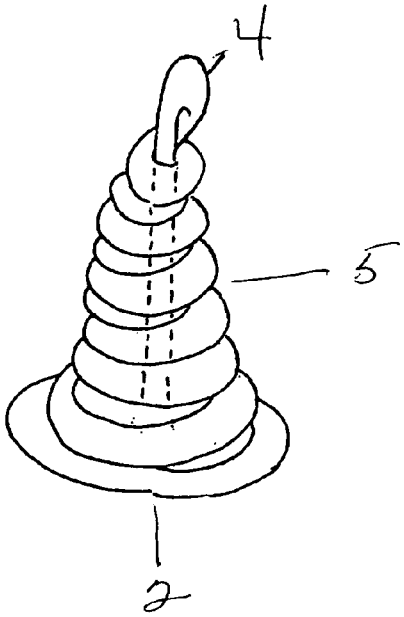
FIG. 5 shows front view of wick tab with wick anchored in place on wick tab with wick stem formed and complete coil of wick around itself.
Figure 6:
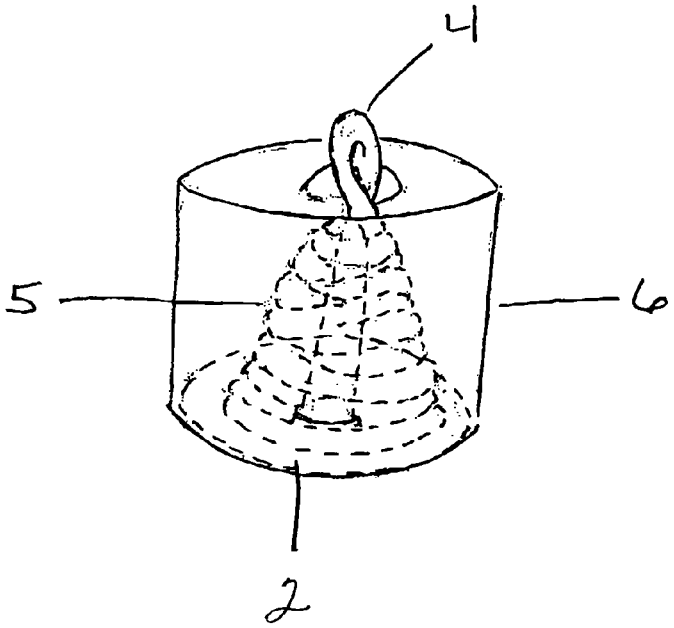
FIG. 6 shows front view of wick in incased in a wax mold.
Figure 7:
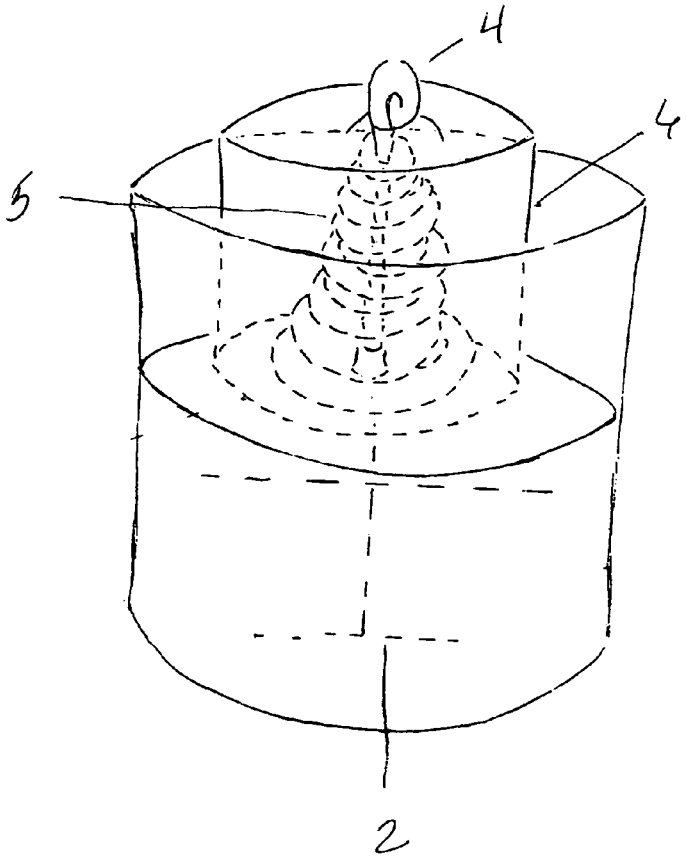
FIG. 7 shows front view of my invention placed on prior art.
Figure 8:
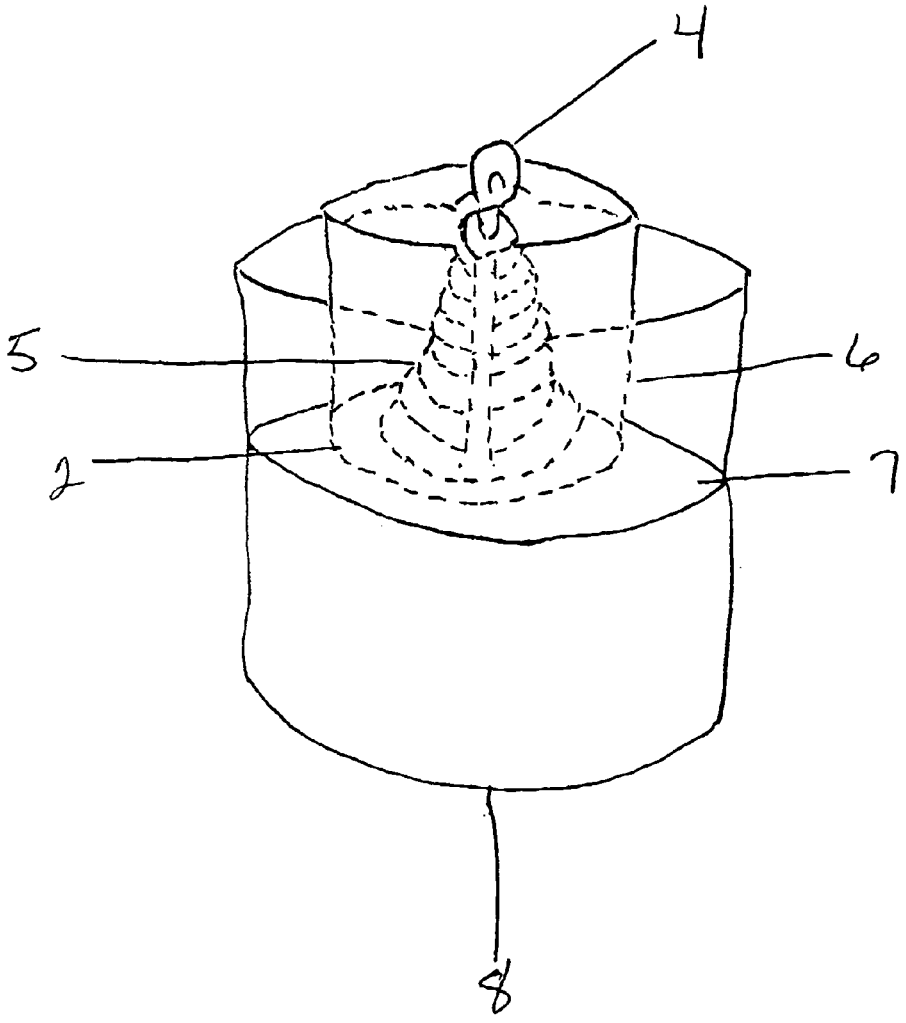

FIG. 8. Shows a new candle comprising a removable and portable candle wick assembly.

DETAILED DESCRIPTION OF THE INVENTION

Removable Wick assembly 6 the wick 5 comprised of wick material such as a flat braid or that can be placed within a candle 1 and used as a wick in place of the standard built-in wick 3 this device is a coiled wick 5 around its self and encased in a wax mold 6 of various shapes and sizes. This devise is anchored on a metal wick tab 2 in order to sit level on top of a flat surface of a meltable body of candle wax 7. Once lit the wax melts away from the encased wick assembly 6 to start an even melting of the candles wax 8 this can be done until a desired amount of candle is burned, then can be removed and placed in a different container until the time of the next use. By coiling this device around its self 5 and encasing it in a candle wax mold 6 the wax is becomes trapped between each level of the coiled portion 5 and the formed stem portion 4 of the devise to keep the devise intact entirely burning the desired amount of wax several times in the same or a different candle because it is a removable portable device with many different capable functions as well as having the ability to ignite charcoal for grills; can also be used as the starting point element for fire places and also improves the burning of citronella candles that often prove troublesome to burn in its entirety. The Invention also provides a candle having a container 8 a first body of meltable wax within the container a free standing portable candle wax assembly resting on top of the first body of meltable wax.

The invention claimed is:

1. A candle comprising:

A container;

A first body of meltable wax within the container;

A free standing portable candlewick assembly resting on top of the first body of meltable wax, the free standing portable candlewick assembly comprising:

A metal candlewick tab having a hole in its center;

A wick comprising a cotton flat braid having a first end and a second end;

Wherein the first end of the wick is situated in the hole of the candlewick tab and a first segment of the wick extends upward and away from the candlewick tab to a top portion of the wick, the first to portion being intermediate the first and second end of the wick, and wherein a second segment of the wick intermediate the top portion of the wick and the second end of the wick extends downward and back to the candlewick tab and winds around the first segment of the wick to form a wound wick assembly, the wound wick assembly having a smallest cross-sectional dimension at the top portion of the wick, the cross-sectional dimension progressively increasing until it reaches a maximum cross-sectional dimension at the candlewick tab; and a section body of meltable wax surrounding the wick and from which the top portion of the protrudes.

2. A free standing portable candlewick assembly comprising;

A metal candlewick tab having a hole in its center;

A wick comprising of a cotton flat braid having a first end and a second end;

Wherein the first end of the wick is situated in the hole of the candlewick tab and the first segment of the wick extends upward and away from the candlewick tab to a top portion of the wick, the top portion being intermediate the first and second end of the wick, and wherein a second segment of the wick intermediate the top portion of the wick and the second end of the wick extends downward and back to the candlewick tab and wounds around the first segment of the wick to form a wound wick assembly, the wound wick assembly having a smallest cross-sectional dimension at the top portion of the wick, the cross sectional dimension progressively increasing until it reaches a maximum cross-sectional dimension at the candlewick tab; and A body of meltable wax surrounding the wick and form which the top portion of the wick protrudes.

* * * * *